US005392850A

United States Patent [19]

Cornette et al.

[11] Patent Number: 5,392,850

[45] Date of Patent: Feb. 28, 1995

[54] SYSTEM FOR ISOLATING MULTIPLE GRAVEL PACKED ZONES IN WELLS

[75] Inventors: H. Mitchell Cornette, Houston; Richard S. Vaclavik, Missouri City, both of Tex.

[73] Assignee: Atlantic Richfield Company, Los Angeles, Calif.

[21] Appl. No.: 187,946

[22] Filed: Jan. 27, 1994

[51] Int. Cl.[6] ..... E21B 33/138; E21B 43/04; E21B 43/08

[52] U.S. Cl. ..... 166/51; 166/164; 166/169; 166/205

[58] Field of Search ..... 166/51, 278, , 276, 166/205, 164, 169, 227, 317, 319, 324

[56] References Cited

U.S. PATENT DOCUMENTS

| | | | |
|---|---|---|---|
| 4,008,763 | 2/1977 | Lowe, Jr. | 166/278 X |
| 4,428,431 | 1/1984 | Landry | 166/278 X |
| 5,090,478 | 2/1992 | Summers | 166/295 X |
| 5,145,045 | 9/1992 | Cornette | 166/278 |
| 5,314,023 | 5/1994 | Dartez et al. | 166/278 X |

*Primary Examiner*—Stephen J. Novosad
*Attorney, Agent, or Firm*—Michael E. Martin

[57] ABSTRACT

A gravel pack screen assembly adapted to produce fluids from two spaced apart zones of interest through gravel packing surrounding spaced apart gravel pack screens includes a sub interposed in the screen assembly between the two screens and having a reservoir for discharging a quantity of permeability reducing material into a layer of gravel packing intermediate the gravel packing surrounding each of the screens. The sub is operable to discharge the material into the gravel pack layer in response to movement of a washpipe or the like within the screen assembly to move an actuator member to cause a closure member to uncover ports in the sub in communication with the reservoir. The actuator member includes a transverse surface projecting into a central bore of the sub and operable to be engaged by deflectable collet fingers formed on a washpipe assembly or a similar member insertable within the gravel pack screen assembly to effect operation of the sub to discharge its permeability reducing material.

19 Claims, 1 Drawing Sheet

SYSTEM FOR ISOLATING MULTIPLE GRAVEL PACKED ZONES IN WELLS

BACKGROUND OF THE INVENTION

1. Field of the Invention

This invention pertains to a multiple gravel pack screen assembly adapted to produce fluids from a well in an earth formation from separate and isolated gravel packed zones wherein a permeability reducing fluid is injected into an intermediate layer of gravel between the zones from a sub interposed in the gravel pack assembly.

2. Background

U.S. patent application Ser. No. 08/137,870, filed Oct. 15, 1993 by H. Mitchell Cornette, et al and assigned to the assignee of the present invention, describes one method of providing a multiple gravel pack type well completion for producing fluids from two spaced apart zones in an earth formation. U.S. Pat. No. 5,145,004 to H. Mitchell Cornette, also assigned to the assignee of the present invention, describes an arrangement for producing fluids from multiple zones utilizing gravel packed wells with an auger gravel pack screen assembly.

In certain wells which are capable of producing fluids from multiple spaced apart zones, intermediate layers of formation material may produce water and/or gas which is unwanted when producing crude oil, for example, from the formation zones on each side of the water or gas producing zone. Moreover, one or the other of the two spaced apart production zones may begin to produce unwanted quantities of water and/or gas. The flow of water and/or gas into an oil production well or water into a gas production well creates several problems such as, in the case of water incursion, requiring artificial lift, development of corrosion of the well structure due to mixing of oil with acidic gases and reduction in the production rate of the desired fluids.

Although patent application Ser. No. 08/137,870 describes one solution to the abovementioned problem which is useful with auger type gravel pack screen assemblies, there are instances when this type of screen assembly can not be used, such as in relatively high angle or substantially horizontal wellbores. In this regard more conventional gravel pack screen assemblies are sometimes required. However, the aforementioned problems associated with isolating spaced apart zones or shutting off production from one zone while producing from an adjacent or closely spaced zone still exist for conventional as well as auger type gravel screen assemblies. Accordingly, the present invention provides a unique solution for multiple gravel pack screen assemblies wherein a permeability reducing material may be injected into a portion of the gravel packing interposed between two spaced apart gravel pack screens, which may be the so called auger type or other types.

Those skilled in the art will recognize this improvement upon reading the summary and detailed description of the present invention which follows herein.

SUMMARY OF THE INVENTION

The present invention provides an improved system for isolating spaced apart gravel packed zones in a well by reducing the permeability of a gravel packing interposed between two gravel pack screens.

In accordance with an important aspect of the present invention a gravel pack screen assembly is provided with a sub interposed in the assembly between two spaced apart gravel pack screens, which sub is adapted to include a reservoir for containing a quantity of gravel packing permeability reducing resin which may be injected into a predetermined zone of gravel packing. The reservoir sub includes a unique mechanism which may be activated by a tubing string inserted within the sub to release permeability reducing material into a layer of gravel packing adjacent to the sub.

The present invention also provides a unique system for isolating spaced apart zones of gravel packing wherein a reservoir sub is interposed between two gravel pack screens and the reservoir sub is activated to inject a permeability reducing resin into a gravel packing by actuation of a piston or closure member to uncover ports in the sub in communication with a permeability reducing material reservoir. The closure member may be activated by withdrawing a tubing string, such as a washpipe assembly, from within the gravel pack screen.

Still further, the present invention provides a unique sub adapted to be interposed in a gravel pack assembly between two spaced apart gravel pack screens which includes a reservoir for dispensing a quantity of permeability reducing fluid material into a gravel packing adjacent to the sub and which sub includes a unique mechanism for injecting the material, at will, into the gravel packing.

Those skilled in the art will recognize the above described advantages and superior features of the present invention as well as other important aspects thereof upon reading the detailed description which follows in conjunction with the drawing.

DESCRIPTION OF PREFERRED EMBODIMENTS

Figure 1:
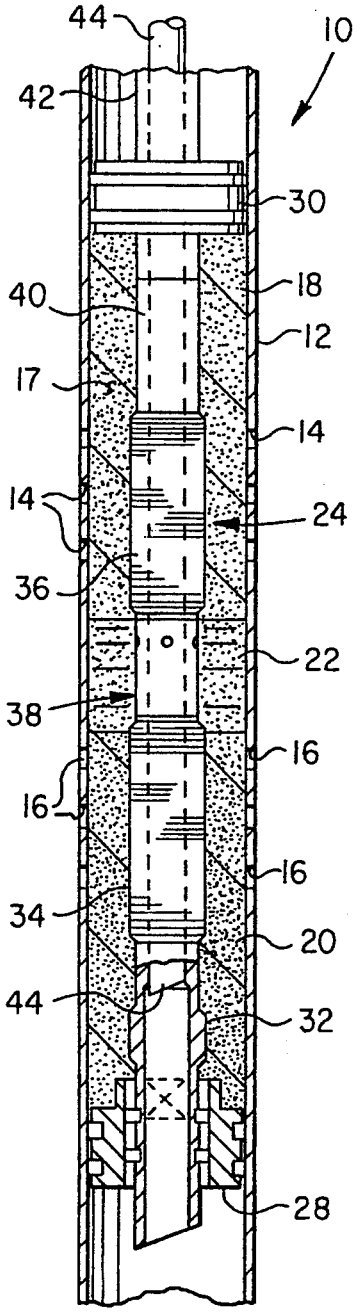
FIG. 1 is a vertical central section view in somewhat schematic form of a dual gravel pack screen assembly installed in a wellbore.

In the description which follows like parts are marked throughout the specification and drawing with the same reference numerals, respectively. The drawing figures are not necessarily to scale in the interest of clarity and conciseness.

Referring to FIG. 1, there is illustrated a portion of a subterranean well 10 including a casing 12 having two sets of spaced apart perforations 14 and 16 which are operable to communicate spaced apart formation zones of interest with wellbore space 17. Spaced apart layers of gravel packing 18 and 20 are separated by an intermediate gravel layer 22 within the space 17. The gravel layer 22 is subject to having its permeability reduced by the present invention. A unique gravel pack screen assembly 24 is installed in the wellbore space 17 between a sump packer and seal assembly 28 and an upper packer and seal assembly 30. The packer and seal assemblies 28 and 30 may be of a type commercially available such as from Halliburton Energy Services, Dallas, Tex. The gravel pack screen assembly 24 includes a so called "tell tale" screen sub 32 which is suitably connected to a first gravel pack screen 34 interposed in the gravel packing 20. A second gravel pack screen 36 is spaced above the screen 34 and is interposed in the gravel packing 18. The gravel pack screens 34 and 36 may be of conventional types also commercially available from Halliburton Energy Services and are interconnected by a unique sub, generally designated by the number 38, which will be described in further detail hereinbelow.

The gravel pack screen assembly 24 may also include a conventional ported flow sub 40 and a blank pipe section 42 extending through the packer 30. The screen assembly 24 is also shown with a removable washpipe or tubing 44 extending therewithin in a conventional manner. The gravel pack screens 34 and 36 are operable to permit flow of fluids through the perforations 16 and 14, respectively, and the respective gravel packings 20 and 18 into the interior of the gravel pack screens, once the washpipe 44 has been removed, so that fluids may be produced from spaced apart earth formation zones of interest adjacent to the respective sets of perforations 16 and 14.

However, in the production of crude oil or gas, for example, from multiple earth formation zones, the nature of the fluids flowing into the wellbore space 17 through the respective sets of perforations may change over the production life of the well. One or the other of the zones may begin to produce water or gas in excessive amounts or an intermediate layer of earth material between the zones which are producing fluids through the perforations 14 and 16 may tend to produce unwanted fluids into the wellbore space 17. In this regard it is desirable to be able to reduce the permeability of the gravel packing within the wellbore space 17, particularly between the spaced apart gravel pack screens 34 and 36. For example, it may be desirable to reduce the permeability of the gravel packing layer 22 so that communication of fluids between the gravel packings 18 and 20 may not occur, or at least be substantially reduced. When this condition is anticipated, the gravel pack screen assembly 24 may be made up in advance with the sub 38 interposed therein. The sub 38 is adapted to provide for injecting, at will, a quantity of permeability reducing material, stored in a reservoir in the sub, into the gravel packing layer 22 to reduce its permeability to the flow of unwanted fluids between the gravel packings 20 and 18.

Figure 2:
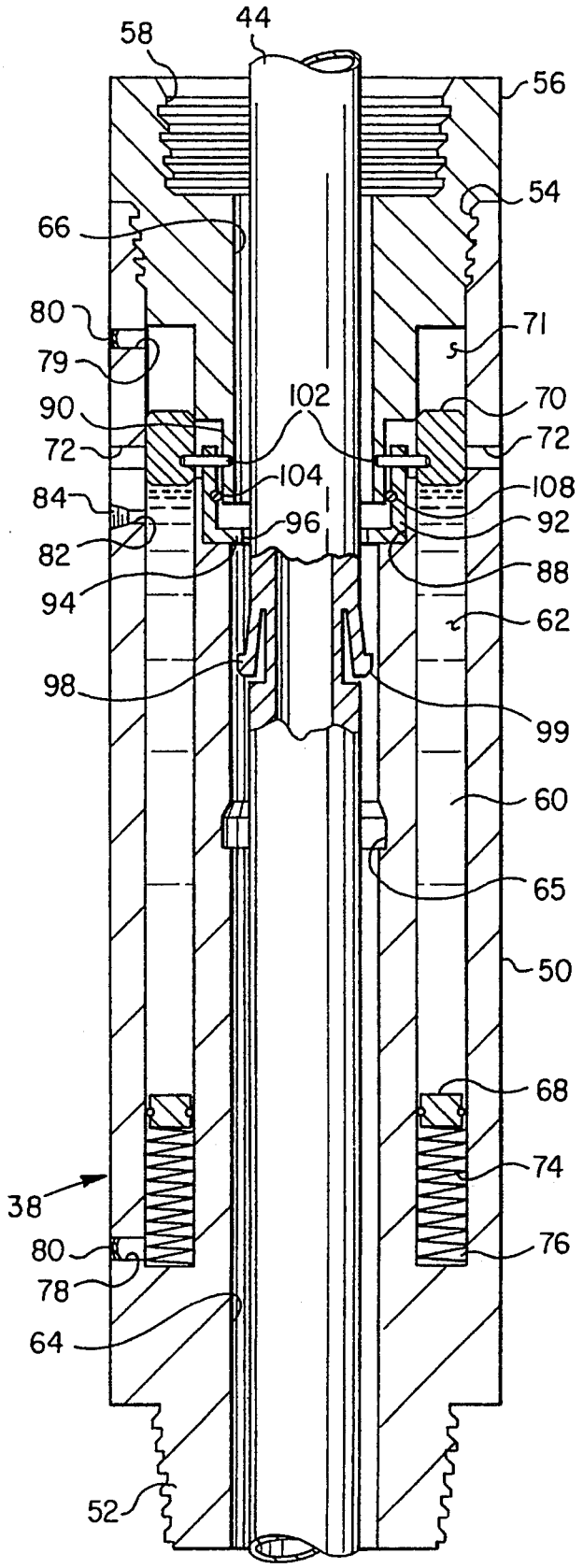
FIG. 2 is a vertical central section view of the permeability reducing material reservoir sub of the present invention.

Referring now to FIG. 2, the reservoir sub 38 is shown in central longitudinal section and is characterized by an elongated tubular member 50 having a lower pin end 52 for threadedly connecting the sub to the screen 34 or to an intervening sub member, not shown. The tubular member 50 has an upper, internally threaded end portion 54 which is adapted to be threadedly connected to a separable sub member 56 having a suitable internally threaded box portion 58 formed thereon. The member 50 includes an elongated annular reservoir space 60 formed therein and which is operable to contain a quantity of fluid material 62 such as a suitable resin or cement fluid which may, when injected into the gravel pack layer 22, substantially reduce the permeability of that gravel packing. The sub members 50 and 56 also include coaxial central longitudinal bore portions 64 and 66, in which is shown the washpipe assembly 44. The bore portions 64 and 66 also provide a flow path for the flow of fluid from the gravel pack screen 34 upward through the screen assembly 24 during production of fluids from the well 10.

As further illustrated in FIG. 2, the permeability reducing fluid or resin material 62 is disposed in the reservoir space 60 between a movable annular piston 68 and a movable annular closure member 70. In the position of the closure member 70 illustrated, exit ports 72 formed in the member 50 are closed from communicating with the reservoir space 60. The fluid resin material 62 within the space 60 is under the urging of the piston 68 from a plurality of suitable resilient spring members 74 disposed in a lower vented end portion 76 of the annular reservoir space 60. A pressure equalizing port 78 opens from the exterior of the sub 38 into the space 76 and has a suitable screen 80 interposed therein to prevent solids debris from flowing into the space 76. A fluid fill port 82 also opens into the space 60 and is closed by a suitable closure plug 84 once the reservoir space 60 has been filled with a quantity of material 62.

The sub 38 includes a unique mechanism for moving the closure member 70 between the position illustrated and a position displaced upwardly, viewing FIG. 2, so that the ports 72 are in communication with the space 60 to allow ejection of the permeability reducing material 62 from the space 60 under the urging of the spring biased piston 68. As shown in FIG. 2, the members 50 and 56 are provided with cooperating annular recesses 88 and 90 in which is disposed a somewhat cup shaped actuator sleeve 92 having a transverse, generally planar bottom part 94 which is delimited by a cylindrical bore 96 to permit movement of the washpipe 44 within the bore spaces 64 and 66. However, the bottom part 94 projects into the bore space 64, 66 to be engageable by suitable means formed on the washpipe 44 such as radially deflectable collet fingers 98.

The actuator member 92 is also engaged with frangible retainer means comprising at least two opposed shear pins 102 which extend through cooperating bores in the actuator member 92 into cooperating bores in a downwardly projecting sleeve portion 104 of the member 56 and defining in part the annular recess 90. The shear pins 102 also project into and are operable to secure the closure member 70 in the position shown in FIG. 2. A suitable resilient seal, such as an o-ring 108, is interposed between the actuator member 92 and the sleeve portion 104 to form a fluid tight seal between the reservoir space 60 and the bore 64, 66 of the sub 38.

Operation of the reservoir sub 38 to discharge a quantity of permeability reducing material 62 into the gravel pack layer 22 may be accomplished by pulling upward on the washpipe 44 until the collet fingers 98 engage the transverse shoulder formed by the actuator member bottom part 94, causing the actuator member 92 to move upwardly and shear the pins 102 at their connection between the actuator member and the sleeve portion 90 of the sub 38. The actuator 92 will then move the closure member 70 upward into a space 71 comprising the other end of the annular reservoir chamber or space 60 and allowing the main part of the reservoir space or chamber 60 to be in communication with the port 72 to forcibly eject the material 62 into the gravel packing 22 under the urging of the piston 68. Accordingly, at a predetermined time in the operation of the gravel pack screen assembly 24 the permeability of the gravel pack layer 22 may be reduced, at will. Once the actuator member 92 has moved to an upward limit position the collet fingers 98 will deflect suitably to allow the washpipe 44 to be withdrawn completely from the gravel pack screen assembly 24. The collet fingers 98 may be suitably configured to have beveled edges 99, for example, to deflect the fingers inwardly to allow the washpipe 44 to be inserted in the bore 64, 66 at any time since movement of the washpipe downwardly into engagement with the actuator member 92 will not cause the actuator member to effect any movement of the closure member 70 from its predetermined position shown in FIG. 2 when the sub 38 is made up into the gravel pack screen assembly 24, initially.

As shown in FIG. 2, the sub 38 may have an internal profile or recess portion 65 formed in the bore 64 to receive a suitable plug or closure member, not shown, so that upon withdrawal of the washpipe 44 from the sub 38 and ejection of the permeability reducing material 62 into the layer 22, such a plug may be inserted into the sub 38, if desired, to block the flow of fluid from the lower zone through the screen 34 and into a fluid production tubing string assembly connected to the gravel pack screen assembly 24.

Those skilled in the art will appreciate from the foregoing description how the unique screen assembly 24 and sub 38 may be utilized to prevent production of unwanted fluids from a multiple production zone gravel packed well. The sub 38 may be made of conventional engineering materials used for downhole wellbore devices.

Although a preferred embodiment of the invention has been described in detail herein those skilled in the art will also recognize that various substitutions and modifications may be made to the gravel pack screen assembly and reservoir sub of the present invention without departing from the scope and spirit of the appended claims.

What is claimed is:

1. A gravel pack screen assembly for producing fluids from two spaced apart zones in an earth formation, said screen assembly comprising:

at least two spaced apart gravel pack screens interposed in and adjacent to respective spaced apart layers of gravel packing; and a sub interposed in said screen assembly between said screens, said sub including a reservoir for holding a quantity of gravel pack permeability reducing material; and means operable at will to discharge said material into a layer of gravel packing intermediate the gravel packing adjacent said screens to reduce the permeability of said intermediate layer.

2. The invention set forth in claim 1 wherein:

said reservoir comprises a space formed in said sub for containing a quantity of permeability reducing material, and said sub includes piston means interposed in said space for urging said material to exit through port means formed in said sub and a closure member operable to move from a position covering said port means to a position opening said port means so that said material may be discharged from said reservoir space into said intermediate layer.

3. The invention set forth in claim 2 wherein:

said sub includes an actuator member engageable with said closure member for moving said closure member between a closed position with respect to said port means and an open position.

4. The invention set forth in claim 3 wherein:

said actuator member includes a part projecting into a bore formed in said sub and engageable with means moveable in said bore to move said actuator member and said closure member from a first closed position to a second open position.

5. The invention set forth in claim 4 wherein:

said actuator member is held in a first position by frangible retainer means.

6. The invention set forth in claim 5 wherein:

said actuator member is operable to be moved by means on a washpipe assembly insertable through said gravel pack screen assembly, including said sub, and cooperable with said actuator member to move said actuator member between said first and second positions.

7. The invention set forth in claim 6 wherein:

said means on said washpipe assembly comprises at least one deflectable finger.

8. The invention set forth in claim 7 wherein:

said finger includes surface means formed thereon engageable with said actuator member to permit insertion of said washpipe assembly into said sub.

9. The invention set forth in claim 1 wherein:

said material comprises a flowable resin.

10. The invention set forth in claim 1 wherein:

said material comprises flowable cement fluid.

11. A reservoir sub adapted to be interposed in a gravel pack screen assembly between two spaced-apart gravel pack screens comprising:

a reservoir portion for holding a quantity of gravel packing permeability reducing material in flowable form; and means operable at will to discharge said material from said sub into a layer of gravel packing disposed between said screens to reduce the permeability thereof.

12. The invention set forth in claim 11 wherein:

said reservoir comprises a space formed in said sub for containing a quantity of said material, and said sub includes piston means interposed in said space for urging said material to exit said sub through port means formed in said sub and a closure member operable at will to move from a position covering said port means to a position opening said port means so that said material may be discharged from said space into said layer of gravel packing.

13. The invention set forth in claim 12 wherein:

said reservoir space comprises an annular chamber formed in said sub and said piston and said closure member comprise annular members, respectively, slidably disposed in said annular chamber.

14. The invention set forth in claim 13 including:

resilient means engageable with said piston for urging said piston to displace said material from said chamber.

15. The invention set forth in claim 13 including:

pressure equalizing port means opening into said space for communicating fluid pressure from the exterior of said sub to act on said piston.

16. The invention set forth in claim 12 including:

an actuator member engageable with said closure member for moving said closure member between a closed position with respect to said port means and an open position.

17. The invention set forth in claim 16 wherein:

said actuator member includes a part projecting into a bore formed in said sub and engageable with means movable in said bore to move said actuator member and said closure member from a first position to a second position.

18. The invention set forth in claim 17 including:

frangible retainer means for holding said actuator member in said first position.

19. The invention set forth in claim 18 wherein:

said frangible retainer means comprises at least one shear pin interconnecting said actuator member with said sub and operable to be sheared to release said actuator member for movement of said closure member to said second position.

* * * * *